United States Patent [19]

Hung

[11] 4,415,783

[45] Nov. 15, 1983

[54] MULTIPOLE DATA SWITCH

[75] Inventor: Peter C. Hung, Stony Brook, N.Y.

[73] Assignee: Porta Systems Comp., Syosset, N.Y.

[21] Appl. No.: 420,322

[22] Filed: Sep. 20, 1982

[51] Int. Cl.[3] ..... H01H 19/54

[52] U.S. Cl. ..... 200/11 A; 200/11 G; 200/238; 200/11 K; 200/16 D

[58] Field of Search ..... 200/8 R, 8 A, 11 R, 200/11 A, 11 G, 11 J, 11 K, 16 B, 16 C, 16 D, 6 A, 155 R, 155 A, 238–247, 252, 253, 258, 260, 271–274, 283, 284

[56] References Cited

U.S. PATENT DOCUMENTS

| | | | |
|---|---|---|---|
| 3,225,149 | 12/1965 | Shlesinger, Jr. | 200/16 D |
| 3,263,033 | 7/1966 | Metzger | 200/8 A |
| 3,311,717 | 3/1967 | Lace | 200/8 R |
| 3,368,041 | 2/1968 | Chambaut | 200/11 A |
| 3,371,168 | 2/1968 | Milner | 200/16 D |
| 3,383,478 | 5/1968 | Mandel | 200/8 R |
| 3,643,042 | 2/1972 | Gratz | 200/16 D |
| 4,171,470 | 10/1979 | Gettig | 200/6 A |
| 4,348,556 | 9/1982 | Gettig et al. | 200/6 A |

*Primary Examiner*—J. R. Scott

*Attorney, Agent, or Firm*—Charles E. Temko

[57] ABSTRACT

A multipole type switch for switching a relatively large plurality of independent circuits from one set of contacts to a second set of contacts by manual or remote operation using a solenoid or linear actuator. The switch utilizes as contacts a simple wire form cantilevered for compliance at one end, and free to move laterally at an opposite end. A plurality of bridging contacts properly sized and plated shorts adjacent pairs of wires together when the contacts move in a rectilinear or arcuate path of motion, causing the wires to laterally deflect, and causing the contacts to bridge pairs of adjacent wires to complete a circuit between them. Insulative members are positioned in the gaps between the wire contacts to limit the degree of flexing of the wires to unitary planes during movement of the bridging contacts.

2 Claims, 4 Drawing Figures

MULTIPOLE DATA SWITCH

RELATED APPLICATION

Reference is made to the copending application of Paul V. De Luca and David Rawlings, Ser. No. 310,124, filed Oct. 9, 1981, under the title "Multipole Data Switch", said application being assigned to the same assignee as the instant application and copending application of Peter Hung, filed Sept. 20, 1982, under the title "Contact Pin and Mounting Construction For Multipole Data Switch" and disclosing and claiming a related invention.

BACKGROUND OF THE INVENTION

This invention relates generally to the field of rotary and linear electric switches with bridging contacts commonly used to selectively connect a large number of independent circuits by moving one set of contacts relative to the other. More particularly, it relates to a switch of the type in which the construction thereof has been substantially simplified to result in ease of manufacture, improved reliability, and relatively low production cost. Devices of this general type are well known in the art, and the invention lies in specific constructional details shown in the disclosed embodiments.

In prior art constructions, it is common to provide a relatively fixed stator mounting a plurality of sets of contacts, and a rotor having resiliently urged pins which selectively bridge the contacts on the stator to establish electrical connections therebetween. Adequate contact depends upon the presence of compression of spring-pressed pins, the tension of which weakens with use, as does the ability of the rotor contact to wipe the surface of the contacts on the stator to remove accumulated oxides thereon.

In many constructions, a mechanical detent means must be provided to selectively affix the adjustment of the stator relative to the rotor. The detenting structure also wears with use, and the snap action of the rotor deteriorates as a result.

In the above identified related application, the invention includes the provision of an improved rotary data switch of the class described, in which the contacts on the stator are formed from short lengths of wire in which first portions thereof pass through the body of the stator to provide a conductive terminal, and second portions thereof are bent through substantially a right angle to lie in the path of bridging contacts extending from a surface of the rotor. As the rotor is moved, the bridging contacts deflect the second portions of the wire to provide a wiping effect tending to remove accumulated oxides and other insulative substances, and depress the second portions to place the same under compression. A plurality of individual fins or septums are positioned between adjacent second portions of the wire to prevent any rotational movement thereof about an axis passing through the first portions thereof, the septums forming vertically oriented pockets within which the second portions of the wires may deflect. The stator is provided with resilient sockets into which the wires are laterally inserted during assembly, and axial movement of the wires within the sockets is limited by a flattened area on the wires immediately adjacent the resilient socket.

SUMMARY OF THE INVENTION

Briefly stated, the invention contemplates the provision of an improved data switch of the type described in the above identified application, in which the construction has been materially simplified to facilitate manufacture without loss of any of the advantages inherent in the earlier construction. Instead of angularly shaped wires forming the contacts to be bridged, the wire contacts are rectilinear in configuration, permitting easier formation and insertion into the body of the stator. As the rotor or moving member is moved, the bridging contacts laterally deflect the free ends of the rectilinear wires to make contact. As in the earlier construction, a plurality of fins or septums are placed between adjacent wires to provide channels within which the free ends of the wires may deflect. As the wire terminals are inserted into sockets in the stator in an axial direction, there is no need to rotationally orient the wire terminals during this operation. Where mechanical means is used for such operation, the terminals may be formed by merely cutting segments from a longer source of wire.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 3:
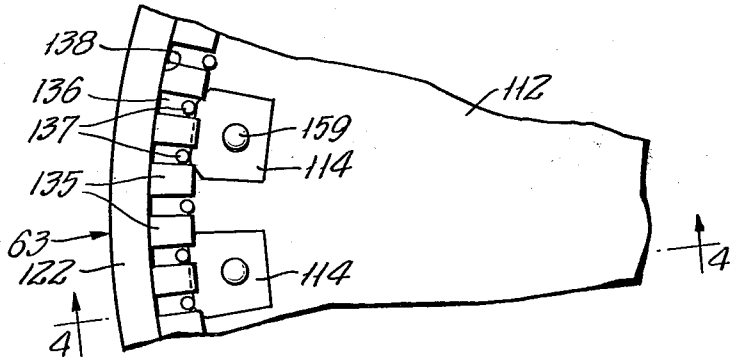
FIG. 3 is a fragmentary top plan view corresponding to that seen in FIG. 1, showing a second embodiment of the invention.

In accordance with the first embodiment of the invention, the device, generally indicated by reference character 10, includes a stator or base element 11, a sliding element 12, a plurality of contact wires 13, and a plurality of contact wipers 14.

The stator element 11 includes a main body preferably formed as a continuous extrusion or by injection molding of synthetic resinous materials. It includes a lower wall 21 of desired length, and first and second side walls 22 and 23, respectively, extending therefrom to define an elongated rectangular recess 24. First and second grooves 25 and 26 extend inwardly from an upper surface 27 of the lower wall 21 to provide guiding means for the sliding element 12. A plurality of parallel bores 28 extend into the wall 21 for the retention of the contact wires 13 in parallel mutually spaced arrangement.

Contacting the upper edge surfaces 30 of the walls 22 and 23 is a cap or cover member 31 of generally planar configuration, and bounded by an upper or outer surface 32 and a lower or inner surface 33, as well as side edges 34. Extending from the inner surfaces 33 is a plurality of short septums 35 forming interstices 36 in which the upper ends 37 of the wires 13 are positioned for limited lateral movement. The outer edges 38 of the septums 35 are slidably engageable with the inner surfaces 39 of the walls 22 and 23 for positioning and retention purposes. A centrally disposed rib 40 projects inwardly of the surface 33 and cooperates with the grooves 25 and 26 to guide the sliding element 12.

The sliding element 12 is also preferably formed as a molding or extrusion. Sliding element 12 includes an upper wall 47 from which depend first and second side walls 48 and 49, respectively. The members 47-49 provide a rectangular recess for the accommodation of a solenoid 51 including a core 52 and coil 53, the core 52 being interconnected at a point not shown in the drawing for transmission of movement to the element 12. The walls 48 and 49 define lower edge surfaces 54 engageable in the grooves 25 and 26. A centrally disposed rib 55 on the upper surface of the wall 47 cooperates with an opposed surface of the rib 40 to complete the guiding means. The wiper contacts 15 are mounted on the upper surface of the wall 47 on either side of the rib 55 which provides a positioning surface enable mounting using a single rivet or enlargement 59.

Figure 1:
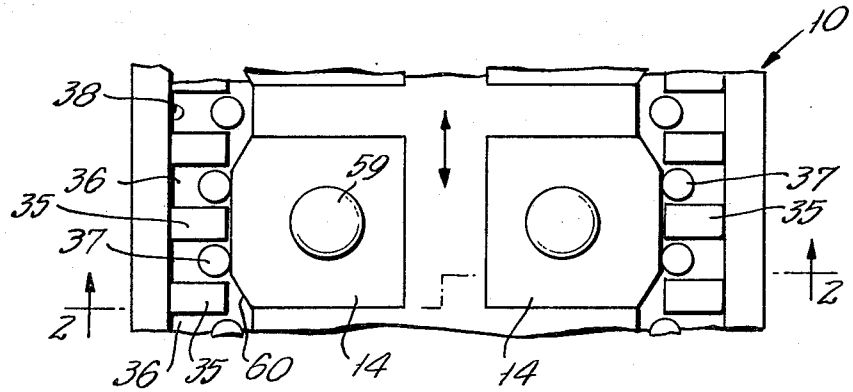
FIG. 1 is a fragmentary top plan view of a first embodiment of the invention, with a cover member removed for purposes of clarity.
Figure 2:
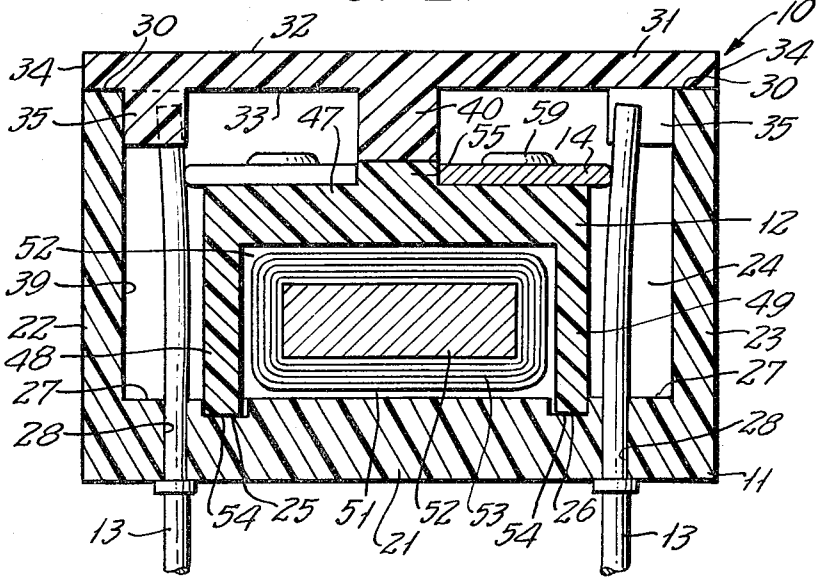
FIG. 2 is a transverse sectional view thereof, with the cover in position.

Referring to FIG. 1, the wiper surfaces 60 are of a configuration similar to that in the above identified application, and are so configured as to permit bridging of adjacent contact wires 13 in a similar fashion. It will be observed, however, that since the wires 13 are substantially rectilinear, only minimal guidance is necessary to insure that they deflect laterally with respect to their own axis since the wires have no tendency to rotate or twist during the deflection imparted by the wiper contacts 15.

Figure 4:
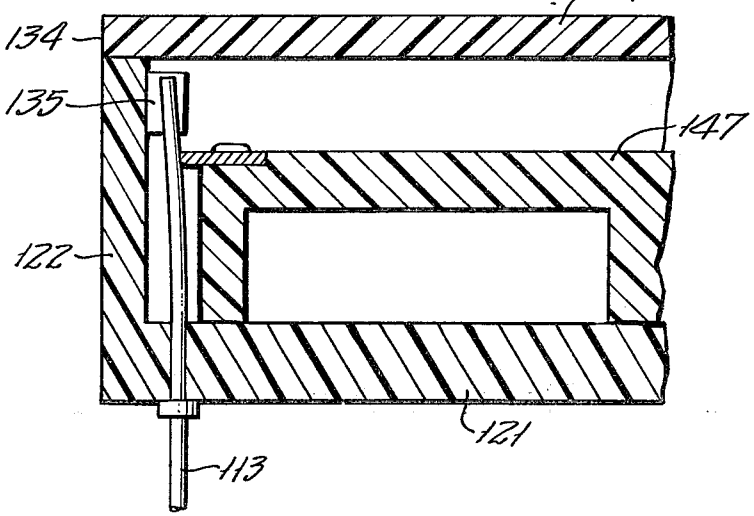
FIG. 4 is a sectional view corresponding to that seen in FIG. 2, but showing the second embodiment.

Turning now to the second embodiment of the invention, generally indicated by reference character 63 and illustrated in FIGS. 3 and 4, parts corresponding to those of the first embodiment have been designated by similar reference characters with the additional prefix "1". The second embodiment differs from the first embodiment only in the arrangement of the sliding member 112 for rotary movement rather than rectilinear movement relative to the stator or base element 111. Movement may be imparted by any desired means, such as a solenoid used in the first embodiment, or by other mechanically imparted movement.

I wish it to be understood that I do not consider the invention limited to the precise details of structure shown and set forth in this specification, for obvious modifications will occur to those skilled in the art to which the invention pertains.

I claim:

1. A multipole switch comprising a base element and a sliding element arranged coaxially for relative incremental movement; said base element including a contact supporting area defining a plurality of parallel bores, a plurality of elongated totally rectilinear wire-like flexible contacts, each of said contacts having a portion thereof inserted in one of said bores and having a free end spaced from said portions; a plurality of septums associated with said base element in the area of said free ends of said contacts, and defining interstices therebetween within which said free ends are laterally deflectable; said sliding element being arranged for relative movement on said base element and having a plurality of contact means projecting therefrom to overlie said flexible contacts to selectively bridge adjacent pairs thereof; said base element including a lower wall containing said bores, a pair of side walls extending upwardly from said lower wall, and a cover member overlying free upper edge surfaces of said side walls to define an elongated cavity, said sliding element being disposed within said cavity; said septums being mounted upon an inner surface of said cover and serving to position said cover member relative to said side walls by contact therewith.

2. A switch in accordance with claim 1, further characterized in said cover element and lower wall forming means for guiding said sliding element for movement relative to said base element.

* * * * *